US005200789A

United States Patent [19]

Oshiumi

[11] Patent Number: 5,200,789

[45] Date of Patent: Apr. 6, 1993

[54] METHOD AND APPARATUS FOR CLEANERLESS IMAGE FORMING

[75] Inventor: Koichiro Oshiumi, Kyoto, Japan

[73] Assignee: Murata Kikai Kabushiki Kaisha, Kyoto, Japan

[21] Appl. No.: 791,047

[22] Filed: Nov. 12, 1991

[30] Foreign Application Priority Data

Nov. 13, 1990 [JP] Japan ..... 2-308081
Feb. 20, 1991 [JP] Japan ..... 3-45707

[51] Int. Cl.[5] ..... G03G 21/00
[52] U.S. Cl. ..... 355/296; 355/270
[58] Field of Search ..... 355/269, 270, 296, 203, 355/208, 215; 118/652

[56] References Cited

U.S. PATENT DOCUMENTS 3,617,123 11/1971 Emerson ..... 355/270 X
4,769,676 9/1988 Mukai et al. ..... 118/652 X
5,034,779 7/1991 Newbury ..... 355/296 X
5,055,882 10/1991 Fushimi ..... 355/269
5,066,982 11/1991 Hosoya et al. ..... 355/269
5,075,729 12/1991 Hayashi et al. ..... 355/269

FOREIGN PATENT DOCUMENTS 0282875 12/1986 Japan ..... 355/270
0118869 5/1989 Japan ..... 355/269

*Primary Examiner*—A. T. Grimley
*Assistant Examiner*—William J. Royer
*Attorney, Agent, or Firm*—Spensley Horn Jubas & Lubitz

[57] ABSTRACT

A cleanerless image forming method for scattering toner remained on an image carrier after transfer by a memory removing member and recovering the same at a developing section, when a power switch is turned on or when jam occurs, includes steps of applying a predetermined voltage to a transfer unit to charge the surface of an image carrier to a predetermined potential and making a potential of a memory removing member lower than a charged potential of the surface of the image carrier whereby toner remained on the memory removing member is redeveloped on the image carrier.

9 Claims, 12 Drawing Sheets

METHOD AND APPARATUS FOR CLEANERLESS IMAGE FORMING

BACKGROUND OF THE INVENTION

1. Field of the Invention

The present invention relates to a cleanerless image forming method and apparatus which is applied, for example, to a printer of an electrophotographic system.

The present invention further relates to an image forming apparatus of the type in which light is exposed to an image carrier to form an electrostatic latent image, and said image is developed by a colored powder to transfer it to a recording medium, and in particular, to an image forming apparatus having a scrotron type transfer means.

2. Prior Art

FIG. 14 is a schematic structural view showing parts around an image carrier of a conventional image forming apparatus of the type as described above. The apparatus comprises a photosensitive drum 1, a charger 2, an exposure means 3, a developer 4, a bias power source 5 of the developer, a recording paper 8, a transfer unit 15, and a cleaner 16. Ordinarily, as the image carrier, a drum-like photosensitive body is used as in this example. The photosensitive drum 1 rotates in a direction as indicated by the arrow.

The image forming process is started by uniformly charging the photosensitive drum 1 by the charger 2, and then an electrostatic latent image is formed by the exposure means 3. The exposure is effected by the slit exposure using an optical system, or the exposure is effected by a laser beam modulated by an image signal. The latent image is developed by toner as a colored powder using the developer 4, and transferred to the recording paper 8 by the transfer unit 15 to effect image formation.

The toner remained on the photosensitive drum after transfer is cleaned by the cleaner 16. As the cleaner 16, a blade **16*a* is used to scrape off the residual toner and is delivered into an external toner recovery box not shown by a carrying screw 16*b***.

The cleaner of the scrape-off type using the blade requires a space for toner recovery box. It is necessary to monitor if the toner recovery box is filled or not. There exists a further problem in that the surface of the photosensitive drum 1 is liable to be scrached by the blade **16*a*** to shorten the life of the photosensitive drum.

A cleaning system without using a scrape-off blade has also been proposed. In an image forming apparatus described in Japanese Patent Publication Unexamined No. 64-20587, there is used a memory removing member. FIG. 15 is a schematic structural view showing parts around the image carrier. Same parts as those shown in FIG. 14 are indicated by the same reference numerals, and description thereof will be omitted. Reference numeral 6 denotes a scorotron type transfer unit; 7 denotes a high voltage power source; 9 denotes a varister; 14 denotes a memory removing member; and 17 denotes a high voltage power source. In this image forming apparatus, it can be used for external output devices such as an electronic computer, a word processor, and so on.

In recording, the photosensitive drum 1 is rotated according to a print start signal, and the charge is made by the charger 2. The charging potential is $V_o$ shown in FIG. 17, for example, −700 V. In the exposure means 3, a laser beam modulated by a dot image data from the electronic computer, the word processor, etc. scans and exposes the photosensitive drum 1 to form an electrostatic latent image.

FIG. 16(A) is an explanatory view of the charging state in the case where toner remained on the photosensitive drum 1 is present. Since the photosensitive drum 1 is charged to the charging potential $V_o$, residual toners a and b are also charged to the same potential $V_o$. The photosensitive body under the residual toners a and b are also charged to the same potential $V_o$.

FIG. 16(B) is an explanatory view of the exposure state. The exposed portion forms an electromagnetic latent image which will be the exposure potential $V_c$ shown in FIG. 17, and therefore, the residual toner b at that portion will also be the exposure potential $V_c$. In the case where the residual toner in the exposure portion is scattered in a small area, for example, one by one, the photosensitive body under the residual toner is also photo-sensitized. In the case where it is gathered in a large area, the photosensitive body thereunder is short in exposure. However, in the case where the exposure-short portion is embedded by toner adhered to a peripheral exposed portion, gathering of residual toner poses no problem. Accordingly, as will be described later, if the residual toner is scatterred to the extent such that the exposure is not affected thereby by the memory removing member, the residual toner can be substantially disregarded.

The developer 4 develops a latent image at the developing potential $V_{b1}$, for example, −450 V. As shown in FIG. 16(C), toner in the developer is developed to the exposed portion and adherred thereto. The residual toner b in the exposed portion remains stayed but poses no problem. Residual toner a in a non-exposed portion is returned to the developer 4, and the toner can be cleaned. A cleaning potential is expressed by a difference between the charging potential $V_o$ and the developing potential $V_{b1}$ below:

$$V_{CL}=V_{b1}-V_o$$

The transfer is effected by a scorotron type charger. By use of the scorotron type, a voltage in excess of 5 kV can be applied to a corona wire **6*a* by a high voltage power source 7 to stabilize the discharge. A varister 9 is connected to a grid 6*b*, and a constant voltage, for example, 560 V, is generated by a part of corona current. Accordingly, a grid potential is 560 V. Toner developed by a transfer potential is transferred to the recording paper 8**, the transferred toner is fixed by a fixing unit not shown, and the recording paper is discharged. The photosensitive drum will be at a potential $V_r$, for example, 100 V, after transfer. The non-exposed portion will be 0 to 80 V.

A memory removing potential $V_{b2}$ is applied to the photosensitive drum 1 by the memory removing member 14 connected to the high voltage power source 17. The appropriate memory removing potential $V_{b2}$ is 100 to 700 V. As the memory removing member 14, a brush is used. The memory removing member 14 has its function that the residual toner is once electrostatically attracted, after which it is naturally discharged to the photosensitive drum 1, and the adherring position on the photosensitive drum 1 is changed whereas as a result, a pattern of the residual toner is diffused.

By the aforementioned function, the residual toner does not obstruct the succeeding exposure, and the residual toner in the non-exposure portion is recovered into the developer simultaneously with the development. This means that cleaning has been done.

The image forming apparatus using the aforementioned cleanerless method is very excellent in that a cleaner is not used. However, there is an inconvenience in that when a power source is opened due to an occurrence of trouble such as jams or when defective transfer of a toner image onto a paper for other causes, un-transferred toner more than that needed are adherred to and staryed on the memory removing member. This results in drawbacks that the memory removing effect (the scattering effect of the residual toner image) is insufficient to render the succeeding image forming operation inconvenient or that toner overflows from the memory removing member to stain paper running thereunder or stain marginal portions.

Furthermore, in the aforementioned image forming process, paper powders is often deposited on the surface of the photosensitive drum. The paper powder generated include those generated when paper are cut into fixed forms, or those generated by contact of paper with rollers, guides, etc. when the paper runs within the apparatus. Further, paper powders is materially generated particularly when reproduced papers is used, resulting in that a large amount of paper powders is adherred to the surface of the photosensitive drum. Defective exposure, defective development, defective transfer, etc. are brought forth at portions where paper powders is adherred unless the powders is adherred, constituting an obstacle to form an image.

Accordingly, it is very important to provide the step of recovering paper powder together with untransferred toner by means of the aforementioned cleaner. However, in the cleanerless image forming apparatus without using a cleaner, paper powder together with untransferred toner are recovered into the developer, resulting in the following inconvenience. That is, the function peculiar to the developer is to make toner within a toner hopper thin by means of a developing roller and a doctor blade to supply a fixed amount of toner to an electrostatic latent image on the surface of the photosensitive drum. However, in the case where paper powder is mixed into the toner hopper, the paper powder is carried along with toner by the developing roller to a position of the doctor blade, at which position the paper powder is clogged.

The grain size of toner is approximately 10–20 μm, whereas the grain size of paper powder is 0.3 mm or more, and therefore, the paper powder cannot pass through a doctor gap (an isolated distance between the doctor blade and the developing roller) and is dammed up by the doctor blade. In the case where such an inconvenience occurs, at a location where paper powder at the position of the doctor blade is clogged, a toner supply-disable state (not-developed state) with respect to the electrostatic latent image on the photosensitive drum results. This causes an image to be formed having with portions whited out (i.e., without toner).

In view of the foregoing, it is desirable to remove paper powder by some method before it is supplied to a transfer unit. However, it is impossible to completely remove paper powder from paper in consideration of nature peculiar to paper. Furthermore, it is necessary to bring paper into contact with the photosensitive drum once without fail in the transfer step, and therefore, adherence of some paper powder to the surface of the photosensitive drum cannot be avoided. Accordingly, in the conventional cleanerless image forming apparatus in which positive removable of paper powder by a cleaner is not effected, it is extremely difficult to completely remove paper powder on the photosensitive drum.

Moreover, when such a residual toner recovery system is employed, the charge of the photosensitive body caused by the transfer unit 6 poses a problem. A potential of the photosensitive body having passed through the transfer unit 6 is affected by the presence or absence of the recording paper. Assume now that in case of presence of the recording paper, a potential $V_{T0}$ after transfer is 100 V, a potential $V_{T1}$ after transfer in case of absence of the recording paper is approximately 400 V. When the photosensitive body is charged to approximately 400 V, which is $V_{T1}$, the toner adherred to the memory removing member 14 becomes developed on the photosensitive body. The toner in this phenomenon will not be a scatterred pattern and therefore constitutes an obstacle in the succeeding exposure stage.

Accordingly, the cleaning system described in the aforementioned patent publication, a voltage applied to the corona wire 6a of the transfer unit 6 is turned on only when the recording paper 8 is passing through under the transfer unit 6, and exposed portions of the photosensitive body before and behind the recording paper 8 are not positively charged.

However, it is difficult to accurately synchronize a carrying position of the recording paper 8 with the turning-on of the high voltage power source 7. Other problems include rise time and fall time when the power source is turned on and off, making it difficult to avoid the charging of the exposed portions of the photosensitive body.

In addition, there is a problem in that a high voltage power source 17 is required for the memory removing member 14 as compared with the case of using a cleaner of the conventional scrape-off system using a blade.

While a description has been made by using a negative charge OPC as a photosensitive drum, it is to be noted that the same is true for a positive-charge OPC.

SUMMARY OF THE INVENTION

A first object of the present invention is to provide an image forming method which can positively effect cleaning operation without a large amount of untransferred toner being adherred to and stayed on a memory removing member even at the time of rise after a power switch has been turned off due to jams or the like.

A second object of the present invention is to provide a cleanerless image forming apparatus which enables positive image formation by positively removing paper powder adherred on a photosensitive drum.

A third object of the present invention is to provide an image forming apparatus capable of employing a residual toner recovery system without requiring a high voltage power source for a memory removing member and without accurate synchronization between a carrying position of recording paper and a turn-on of a high voltage power source.

The present invention provides a cleanerless image forming method for scattering toner remained on an image carrier after transfer by a memory removing member and recovering the same at a developing section, comprising a descrimination step of discriminating a moment when a power switch is turned on, and an execution step of applying a predetermined voltage to a transfer unit when the power switch is turned on, setting a potential of the memory removing member to zero potential and redeveloping toner remained on the memory removing member to said image carrier.

According to the present invention, there is provided a cleanerless image forming method for scattering toner remained on an image carrier after transfer by a memory removing member and recovering the same at a developing section, comprising a jam monitor step for monitoring presence or absence of occurrence of jam, and an execution step of applying, when the jam occurs, a predetermined voltage to a transfer unit to charge the surface of the image carrier to a predetermined potential and making a potential of the memory removing member lower than a charged potential of the surface of the image carrier whereby toner remained on the memory removing member is redeveloped on the image carrier.

According to the present invention, there is further provided a cleanerless image forming apparatus for scattering toner remained on an image carrier after transfer by a memory removing member, recovering the same at a developing section and effecting the succeeding image formation, characterized in that in the surface of the image carrier after transfer, paper powder capture and recovery means for capturing adherred paper powder and recovering a predetermined amount thereof is placed in contact with a position upstream in the moving direction direction of said image carrier from the residual toner scattering position by way of the memory removing member.

According to the present invention, there is still further provided an image forming apparatus comprising charge means for charging an image carrier, exposure means for forming an electrostatic latent image on said image carrier, development means for developing said electrostatic latent image by colored powder, scorotron type transfer means for transferring the developed colored powder to a recording medium, and a memory removing member in contact with said iamge carrier to disturb the residual colored powder, characterized in that a grid potential of said scorotron type transfer means is used as a power source applied to said memory removing member, preferably, memory means is provided on the power source, said memory means comprising a capacitor, a directive element capable of being interposed in a charging circuit thereof.

According to the present invention, there is further provided an image forming apparatus comprising charge means for charging an image carrier, exposure means for forming an electrostatic latent image on said image carrier, development means for developing said electrostatic latent image by colored powder, scorotron type transfer means for transferring the developed colored powder to a recording medium, and a memory removing member in contact with said image carrier to disturb the residual colored powder, characterized in that a grid potential of said scorotron type transfer means is used as an applied power source to said memory removing member through memory means, and the power source of said transfer means is applied before the transfer.

DETAILED DESCRIPTION OF THE EMBODIMENTS

Figure 1:
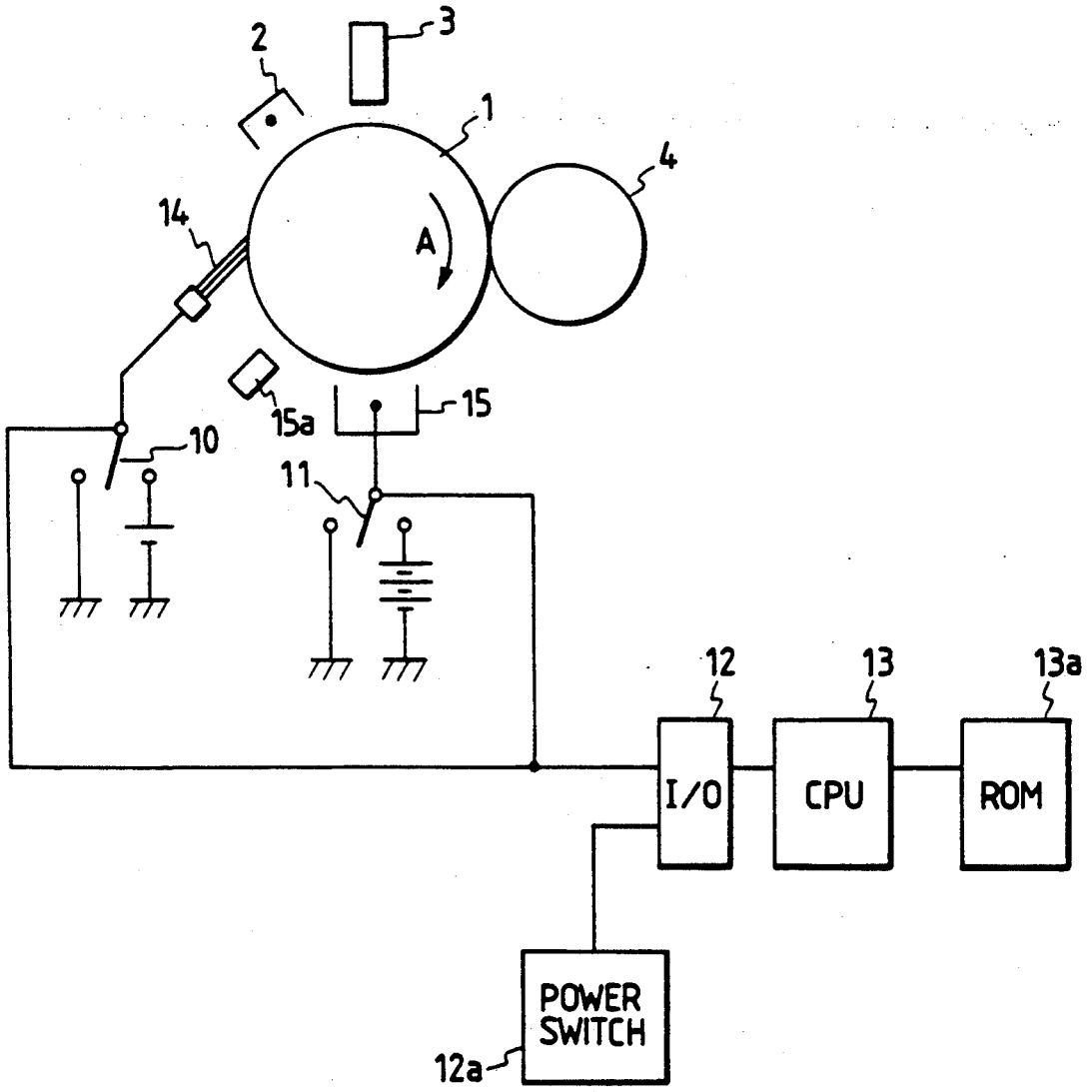
FIG. 1 is a structural view showing a cleanerless image forming method according to the present invention.

The operation of the cleanerless image forming method will be described with reference to FIG. 1. First, a photosensitive drum 1 rotates in a direction as indicated at arrow A, and a charger 2 charges a surface of the photosensitive drum 1 accordingly. Next, a photo-write unit 3 (exposure means) emits light corresponding to an image signal applied from a scanner portion not shown to expose the surface of the photosensitive drum 1. Thus, an electrostatic latent image is formed on an exposure section. A developer 4 installed upwardly to the right of the photosensitive drum 1 supplies toner to the electrostatic latent image to form a toner image (a visible image).

On the other hand, paper (not shown) is supplied to a transfer unit 15 provided opposedly of the photosensitive drum 1 in synchronism with the image forming process by a carrying device not shown so that a toner image on the drum 1 is transferred onto paper. The toner on the paper with the toner image transferred thereon is fixed by a fixing device (not shown) and thereafter removed outside the apparatus.

In the photosensitive drum 1 already subjected to the transfer step, untransferred toner remained on the surface of the drum 1 are scattered by means of a memory removing member 14 comprising a conductive brush or a conductive rubber roller, after which the succeeding image forming operation, i.e., charging, photo-writing and development are carried out. The developer 4 further performs its own developing operation and simultaneously removes the scatterred residual toner by the memory removing member 14.

Figure 2:
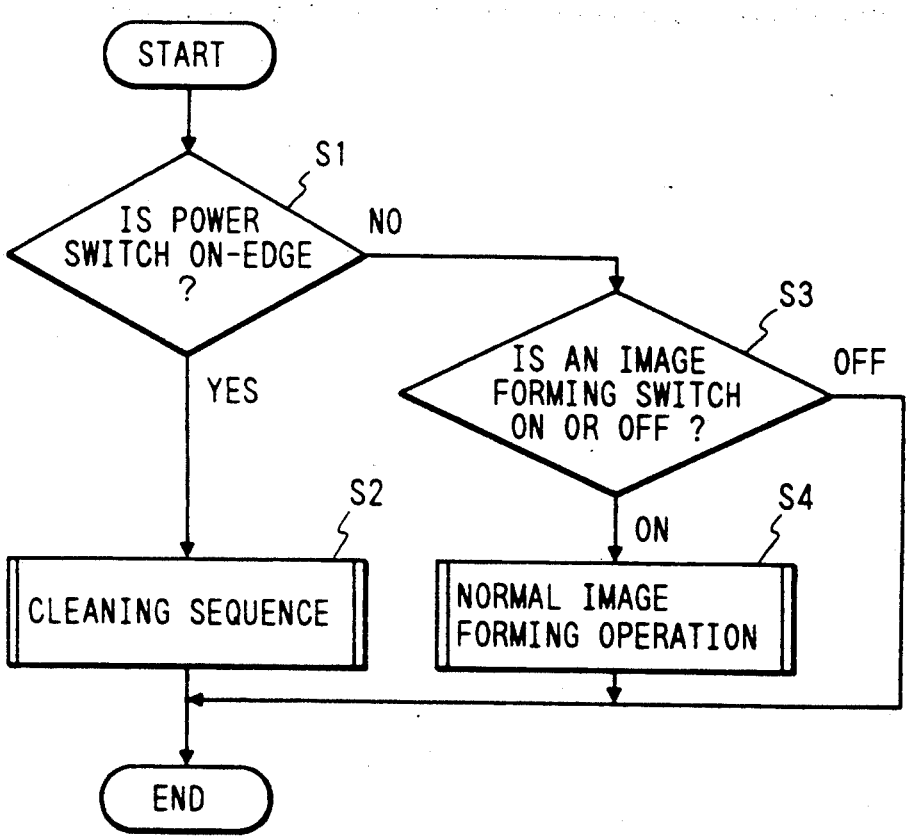
FIG. 2 is a flow chart showing the processing procedure.

In addition, both the transfer unit 15 and the memory removing member 14 are provided with switches 10 and 11, respectively, so as to be capable of being applied with voltage or grounded. These switches 10 and 11 are controlled to be switched by CPU 13 through an I/O interface 12. The CPU 13 is also connected to a power switch 12*a* of the image forming apparatus through the I/O interface 12 to discriminate the on-edge state of the power switch 12*a*. These operations by the CPU 13 are executed in accordance with programs stored in ROM 13*a* (see FIG. 2, flow chart). Next, the processing procedure in the cleanerless image forming method according to the present invention will be described with reference to the flow chart of FIG. 2.

In step 1 (S1), discrimination is made if the power switch 12*a* is in the on-edge state. In case of the on-edge state, the execution proceeds to step 2 (S2), and the cleaning sequence of the memory removing member takes place. In the case of no on-edge state (in the state in which the power switch 12*a* is on), the execution proceeds to step 3 (S3).

In step 3 (S3), discrimination is made if the image forming start switch is on or off. In the case where the on-state is assured, the execution proceeds to step 4 (S4) and the normal cleanerless image forming operation takes place. In the case of off-state, the pocessing is terminated without carrying out the image forming operation.

Figure 3:
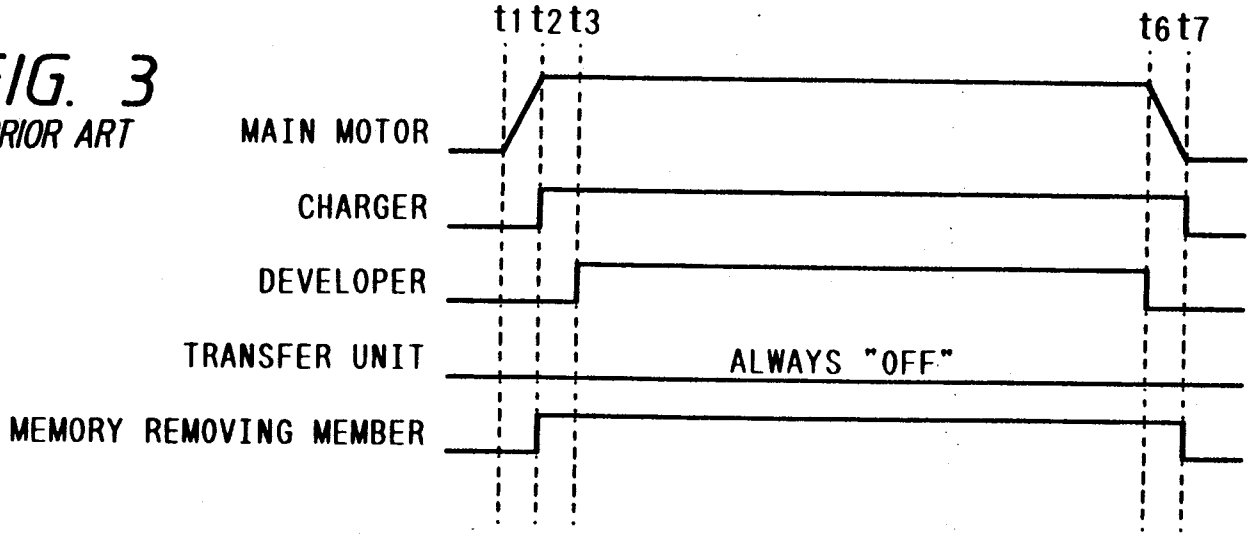
FIG. 3 PRIOR ART
FIG. 3 is a time chart showing the operating sequences of devices in a conventional cleanerless image forming method.
Figure 4:
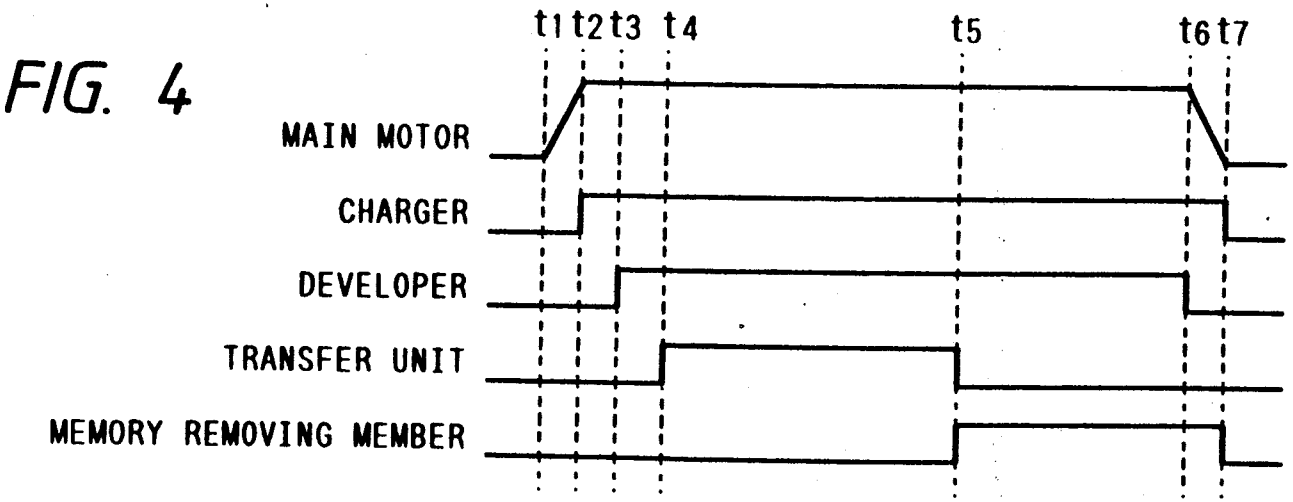
FIG. 4 is a time chart showing the operating sequences of devices.

FIG. 4 is a time chart for the operating sequence of devices. The control of the switch 11 provided on the transfer unit 5 and the switch 10 provided on the memory removing member 14 will be described comparing with FIG. 3 which shows a conventional example.

As shown in FIGS. 3 and 4, the power switch 12*a* (main motor switch) is turned on to rotate the photosensitive drum 1 at time $t_1$. At time $t_2$ when the drum 1 is appropriately rotated, the surface of the drum 1 is charged to a predetermined potential by the charger 2. Thereafter, at time $t_3$, the developer 4 is applied with bias to a predetermined voltage. At time $t_6$, a main motor switch is turned off, and at time $t_7$ at which motor stops, the charger 2 is turned off so that the photosensitive drum 1 assumes a zero potential. The developer 4 is disconnected from the bias application at time $t_6$ at which the main motor switch is turned off to assume a zero potential. The operation so far described is the same as the case of prior art.

The present operation is different from prior art in on/off timing of application of a predetermined voltage with respect to the transfer unit 15 and the memory removing member 14. In the past, in the transfer unit 15, the non-applied state continues, after transfer, till the next transfer step (see FIG. 3). In the present invention, in the transfer unit 15, a predetermined voltage is applied to the developer 4 at time $t_3$, after which a predetermined voltage is again applied at time $t_4$. At the same time, the memory removing member 14 is set to a zero potential. Re-development of the residual toner from the memory removing member 14 to the photosensitive drum 1 is carried out while the potential of the transfer unit 15 and the memory removing member 14 maintain said state (basically, during one revolution of the drum 1). Thereafter, the residual toner and the re-developed toner are scattered on the photosensitive drum 1 at time $t_5$. Therefore, a predetermined voltage is applied to the memory removing member 14, and then the voltage is turned off simultaneous with the charger 2 at time $t_7$.

The aforementioned voltage application operation is executed by the devices whereby the cleanerless image forming method according to the present invention will be carried out.

As described above, according to the present invention, in the cleanerless image forming method, even if the power switch of the image forming apparatus is turned off as the result of occurrence of trouble such as the jam, the moment when the power switch is again turned on is discriminated and immediately the toner remained on the memory removing member is re-developed on the image carrier and scattered. Therefore, the cleaning operation by the developer can be positively effected. Accordingly, in the cleanerless image forming method, the image quality can be further improved.

Figure 5:
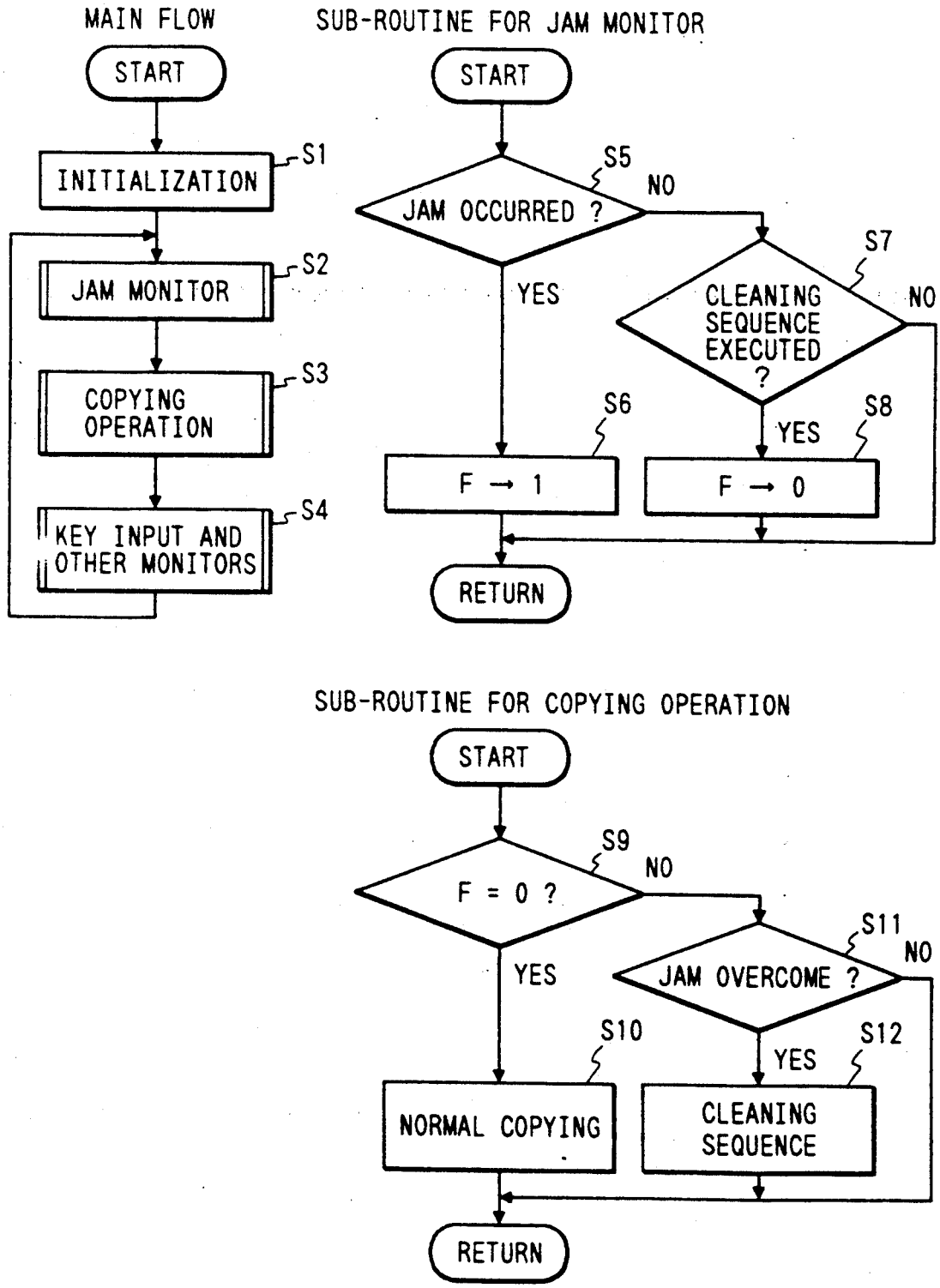
FIG. 5 is a further flow chart showing the processing procedure of the cleanerless image forming method.

FIG. 5 shows a main flow of a second cleanerless image forming method according to the present invention, a sub-routine for jam monitoring, and a sub-routine for copying operation. According to the main flow, first, in step S1, initialization of a system for image formation is carried out. Next, in step S2, the sub-routine for jam monitoring is executed. Thereafter, in step S3, the subroutine for essential copying operation is executed. Further, in step S4, sub-routine for monitoring key-input and others is executed. Basically, the cleanerless image forming method is carried out in accordance with the aforesaid main flow.

In the jam monitoring sub-routine, first, in step S5, the presence of absence or the jam occurrence is discriminated. In case of the jam occurrence, in step S6, flag F is set to 1. In case of absence of the jam occurrence, in step S7, discrimination is judged if the cleaning sequence is executed. Here, the cleaning sequence is the sub-routine executed in the case where after the interruption of the image forming operation because of occurrence of the jam, after which the jam is overcome (the operation thereof will be described with reference to the time chart shown in FIG. 6), including a series of sequences from the cleaning operation to the printing operation). In the case where the cleaning sequence is executed, in step S8, flag F is set to 0. In the case where the cleaning is not executed, the jam is not overcome, and therefore, the processing is terminated.

In the sub-routing for copying operation, in step S9, discrimination is made if flag F is 0. In the case where flag is 0, the jam does not occur. Therefore, in step S10, the sub-routine for normal copying operation is executed. In the case where flag F is not 0, namely, in the case where flag F is 1, the jam occurs. Therefore, in step S11, discrimination is made if the jam is overcome. In the case where the jam is overcome, in step S12, the cleaning sequence is executed. In the case where the jam is not overcome, processing is terminated.

Figure 6:
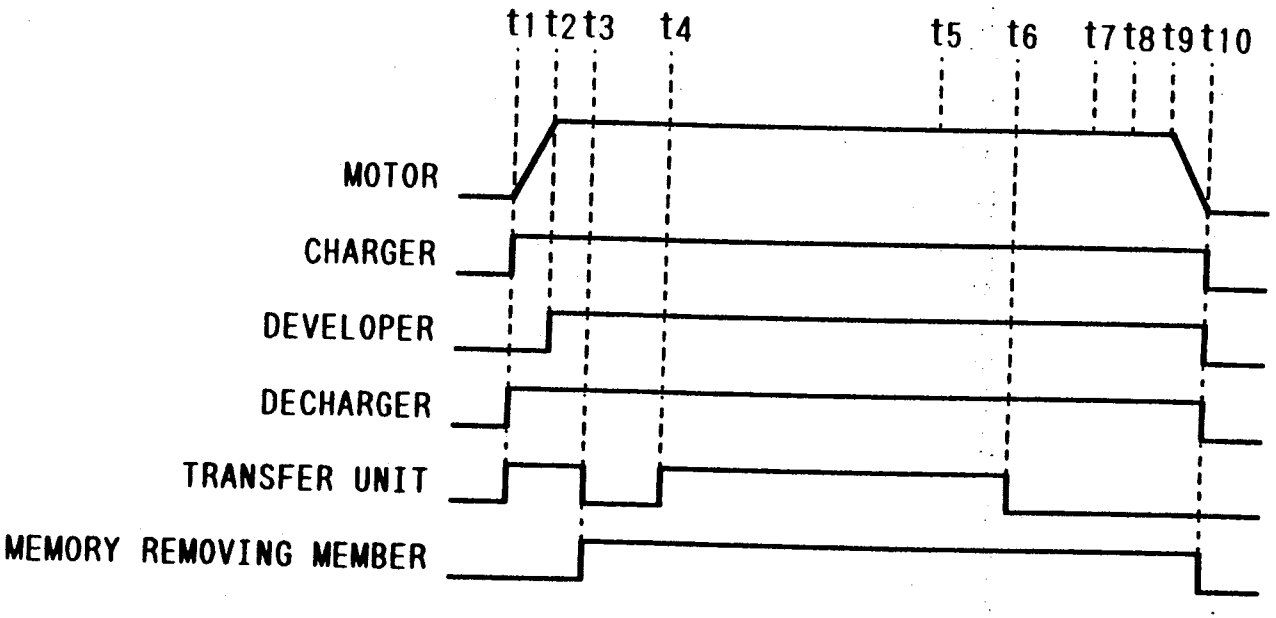
FIG. 6 is a time chart showing the cleaning sequences.

FIG. 6 shows a time chart of a cleaning sequence in a second image forming method. As will be apparent from the figure, in this time chart, since the cleaning operation after the jam has been overcome is added, the operating time is longer than the conventional printing sequence. The operation of devices will be described in order. The motor for rotating the photosensitive drum 1 is turned on at time $t_1$. Simultaneously, the charger 2 and the discharging lamp 15*a* are turned on. At time $t_2$, when the motor has assumed a predetermined rotational speed, the developer 4 is turned on. At time $t_9$, the motor is turned off, rotational speed of which is lowered. At time $t_{10}$, the motor stops. Simultaneously, the charger 2, the developer 4 and the discharging lamp 15*a* are turned off.

Attention has been paid to the transfer unit 15 and the memory removing member 14. Conventionally, the transfer unit 15 is applied in bias at $t_3$ after the photosensitive drum 1 has been charged to a predetermined potential. In this cleaning sequence, however, the transfer unit 15 is turned on simultaneously when the motor is turned on at time $t_1$, and the transfer unit 15 is turned off at time $t_3$. Therefore, during the time from $t_1$ to $t_3$, the photosensitive drum 1 is charged to a predetermined positive potential. On the other hand, the memory removing member 14 is in the off state during the time from $t_1$ to $t_3$, maintaining a zero potential. Accordingly, during that period, the toner remained on the memory removing member 14 is re-developed on the surface of the photosensitive drum 1.

At time $t_4$, the transfer unit 15 is again turned on, and printing starts. At time $t_6$ when the transfer is finished, the transfer unit 15 is turned off. At time $t_3$, the memory removing member 14 is turned on, and executes the memory removing function during printing. At time $t_{10}$, the memory removing member 14 is turned off.

According to the above-described invention, in execution of the cleanerless image forming method, occurrence of jam is always monitored. When the jam occurs, the image carrier is subjected to cleaning without fail so that toner in an amount in excess of the toner recovery ability is never supplied to the developer. Accordingly, even when the jam occurs, the toner recovery operation by the developer is not obstructed.

Further, since the surplus toner remained on the memory removing member is scattered after it is re-developed on the image carrier, the positive memory removing effect can be attained. Accordingly, the quality of image formed can be further improved.

Moreover, it is possible to prevent the toner from being overflown from the memory removing member to contaminate the peripheral portion, thus improving the environment.

Figure 7:
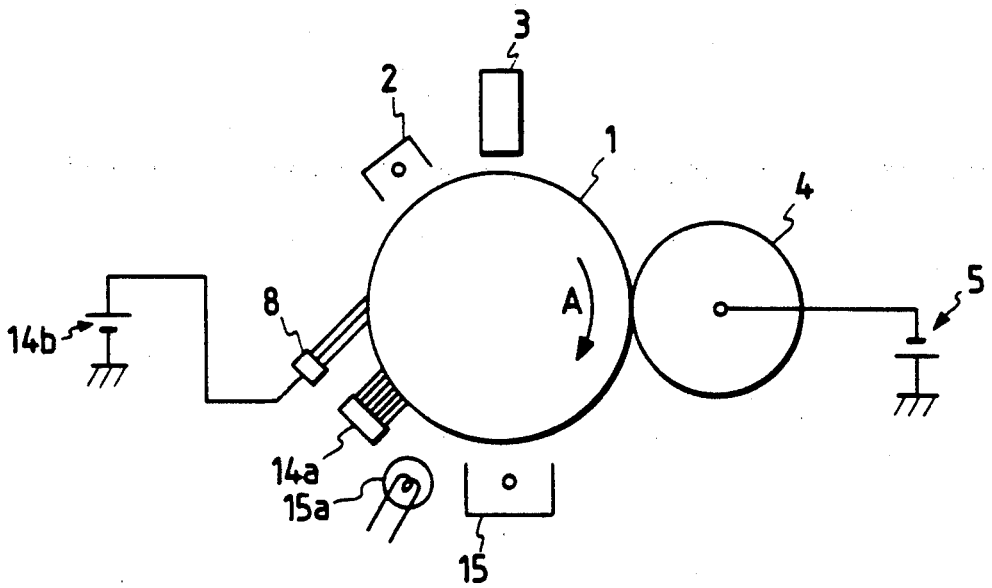
FIG. 7 is a structural view showing essential parts of a cleanerless image forming apparatus according to the present invention for achieving a second object.

FIG. 7 is a structural view showing essential parts of a cleanerless image forming apparatus according to the present invention for achieving the second object. The operation of the apparatus will be described with reference to the drawing. First, the photosensitive drum 1 rotates in a direction as indicated at arrow A, and the charger 2 charges the surface of the drum 1 accordingly. Next, the optical-write unit 3 emits light according to an image signal applied from a scanner section not shown to expose the surface of the drum 1. Thus, an electrostatic latent image is formed on the exposure portion. Subsequently, the developer 4 installed on the right side of the photosensitive drum 1 supplies toner to the electrostatic latent image to form a toner image (a visible image).

Paper is supplied to the transfer unit 15 provided opposedly of the photosensitive drum 1 by the carrying device not shown in synchronism with the image forming step as described above to transfer the toner image on the photosensitive drum 1 to the paper. The toner on the paper with the toner image transferred thereto is fixed by a fixing unit (not shown), after which it is taken out.

On the other hand, the photosensitive drum 1 having been subjected to the transfer step receives discharging action by the discharging lamp 15*a* as the drum rotates. Thereafter, paper powder is removed by a paper powder removing brush 14*a* (see FIG. 8), and the memory is removed by a memory removing brush 8. The photosensitive drum 1 subjected to the memory removal shifts to the next image forming step. The developer 4 recovers the residual toner and performs the next developing operation.

A positive power source 14*b* is connected to the memory removing brush 8 so that the untransferred toner remained on the photosensitive drum 1 is once recovered onto the brush by the electrostatic attraction, and the toner overflown from the brush is again released onto the photosensitive drum. By doing so, the residual toner is scattered on the photosensitive drum 1 to remove the memory. A negative power source 5 is connected to the developer 4 so that the residual toner on the photosensitive drum 1 is recovered into the developer 4 by the electrostatic attraction. The recovered toner is re-used for the next development by the developer 4.

Figure 8:
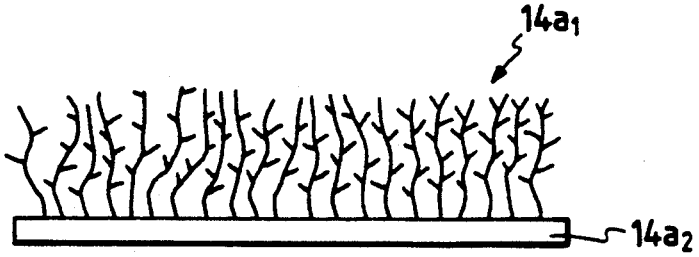
FIG. 8 is an enlarged side view showing a paper powder removing brush.

FIG. 8 is an enlarged side view showing the paper powder removing brush 14*a*. This brush 14*a* is to capture and recover paper powder deposited on the photosensitive drum 1, the brush 14*a* being placed in contact with the surface of the photosensitive drum 1 by a holding member not shown. The brush 14*a* is formed of carpet-like fabrics and is composed of a rising brush portion $14a_1$ and a base material $14a_2$. As the material for the brush portion $14a_1$, there can be used fibers having a number of branch-like projections on the surface thereof. In this embodiment, processed yarns using rayon are used. Of course, other chemical fibers such as synthetic spun yarns formed with a number of branch-like projections on the surface thereof can be also used. As for the coarseness of fibers (corresponding to hardness), suitable coarseness is selected which will not damage the surface of the photosensitive drum 1.

The paper powder removing brush 14*a* is secured to the holding member not shown by adhering the base material $14a_2$ by an adhesive tape. The brush density and brush length are determined in consideration of the life of the photosensitive drum. Normally, the photosensitive drum 1 is exchanged after 10,000 to 30,000 copies have been taken as a standard. It is therefore desirable to form the brush portion $14a_1$ so that the amount of paper powder generated from 10,000–30,000 sheets of paper can be recovered. By doing so, the exchange of the paper powder removing brush 14*a* can be made at the same time when the photosensitive drum 1 is exchanged, which is very convenient.

With the aforementioned arrangement, the paper powder removing brush 14*a* is placed in contact with the surface of the photosensitive drum 1 after transfer whereby the fibers constituting the brush portion $14a_1$ form a net-like construction through branch-like projections. Therefore, the paper powder on the photosensitive drum 1 is captured on the brush portion $14a_1$. The captured paper powder are entangled and are not disengaged from the brush portion $14a_1$. In addition, since the paper powder holding ability of the brush portion $14a_1$ is made to correspond to the paper powder generation amount from 10,000–30,000 sheets of paper, the captured paper powders is not again returned to the surface of the photosensitive drum 1 till the amount of powder reaches the amount in excess of the aforesaid holding ability.

The grain size of the residual toner on the photosensitive drum 1 is 10 to 20 $\mu$m, which is sufficiently small as compared with the size of the paper powder (0.2 mm or more), and the toner is not captured by the paper powder removing brush 14a. Therefore, after having passed through the paper powder removing brush 14a, the residual toner moves to a position with which the memory removing brush 14a is placed in contact and subjected to the memory removing action. It is to be noted that the present invention can be applied also to the cleaner system image forming apparatus.

As described above, according to the present invention, in the cleanerless image forming apparatus, the paper powder removing means is placed in contact with the image carrier after transfer, and therefore, the paper powder deposited on the image carrier can be positively removed. Further, the removal of paper powder is carried out before the residual toner is scattered by the memory removing member. Therefore, no inconvenience occurs in which the paper powder is captured by the memory removing member and the captured paper powder is again returned to the image carrier. As the result, since the paper powder is not recovered into the developer portion, the development is not at all obstructed. Accordingly, in the cleanerless image forming apparatus, the white-out phenomenon caused by the paper powder does not occur in the formed image, and the stabilized image formation can be performed.

Since the paper powder removing means has a recovery ability of paper powder corresponding to a predetermined amount of paper powder expected, the removing means need not be exchanged often, which is very convenient in use.

Figure 9:
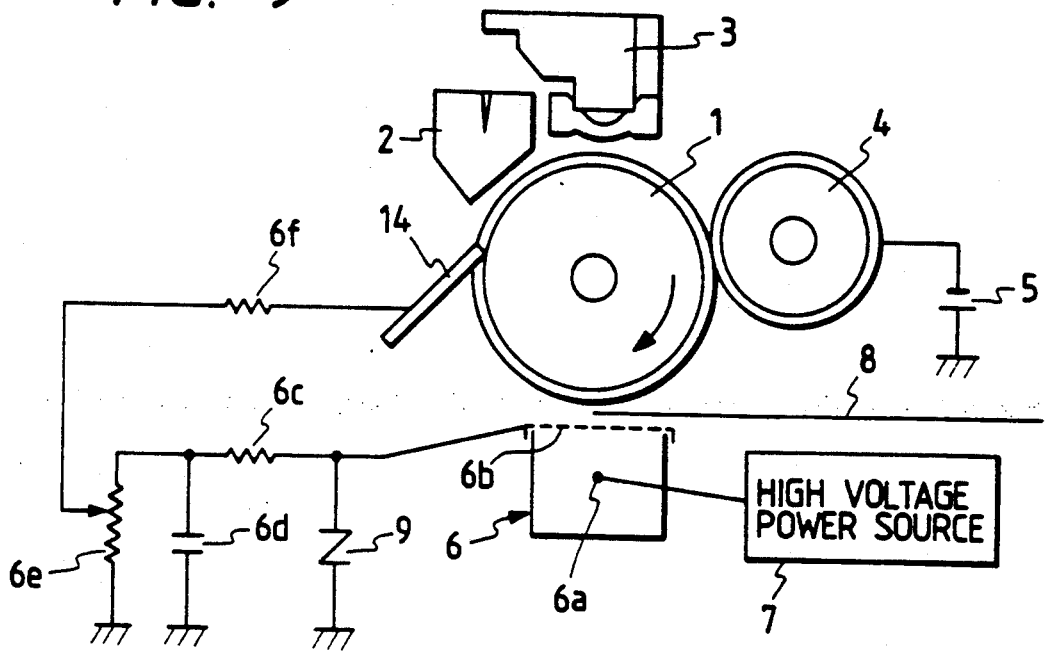
FIG. 9 is a schematic structural view showing parts around an image carrier according to one embodiment of an image forming apparatus for achieving a third object.

FIG. 9 is a schematic structural view showing parts around the image carrier according to one embodiment of an image forming apparatus of the present invention for achieving the third object. In FIG. 9, reference numeral 1 denotes a photosensitive drum; 2 a charger; 3 exposure means; 4 a developer; 5 a barrister power source of the developer; 6 a scorotron type transfer unit; 7 a high voltage power source; 8 a recording paper; 9 a varister; 6c a resistor; 6d a capacitor; 6e a variable resistor; 6f a resistor; and 14 a memory removing member. As the memory removing member 14, there can be used a fixed brush, a rotary brush, a roller, a blade, etc. A description will be made of the case used for external output devices such as an electronic computer, a word processor, etc. similar to that described in connection with FIG. 15.

Figure 15:
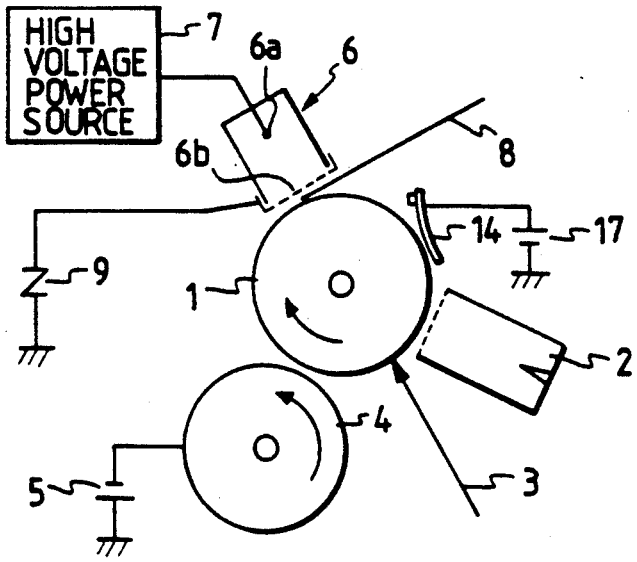
FIG. 15 PRIOR ART
FIG. 15 is a schematic structural view showing parts around an image carrier of a conventional image forming apparatus using a memory removing member.
Figure 16A:
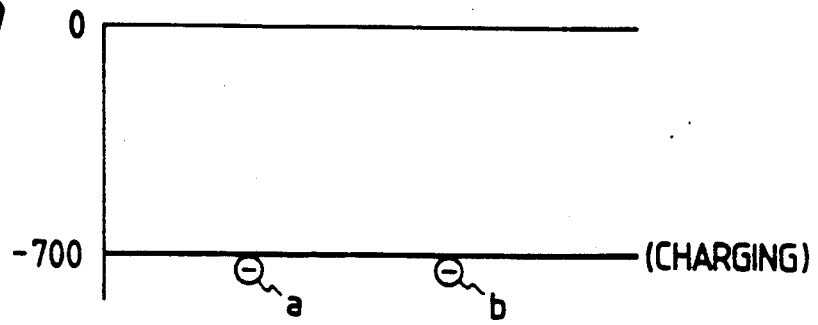
FIG. 16a PRIOR ART
FIGS. 16*a*–16*c* are an explanatory views for the cleaning function of the memory removing member.
Figure 16B:
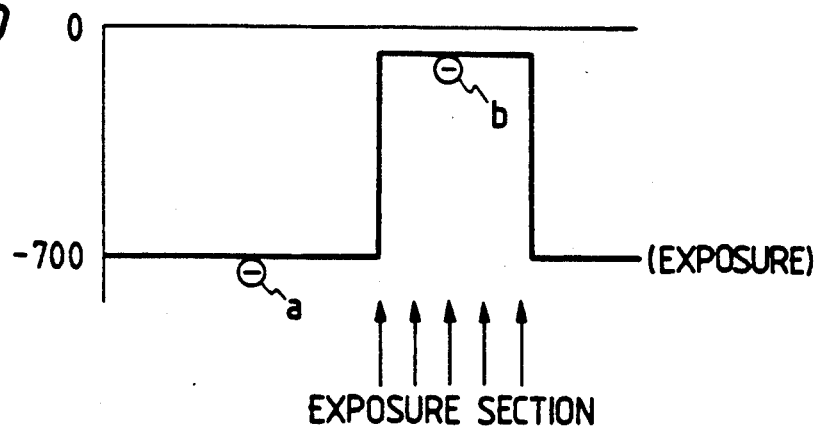
FIG. 16b PRIOR ART
Figure 16C:
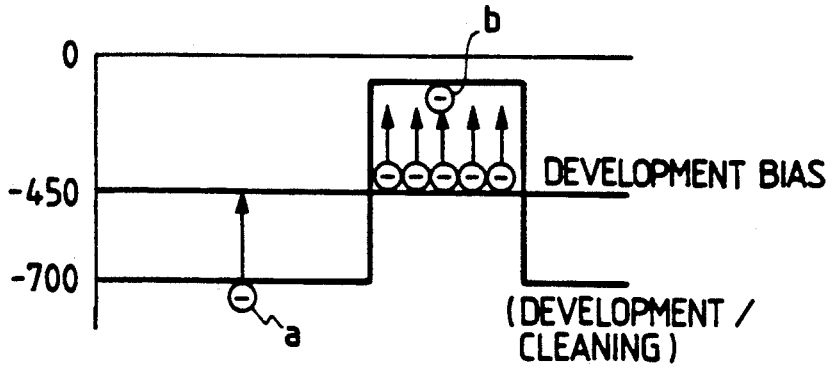
FIG. 16c PRIOR ART
Figure 17:
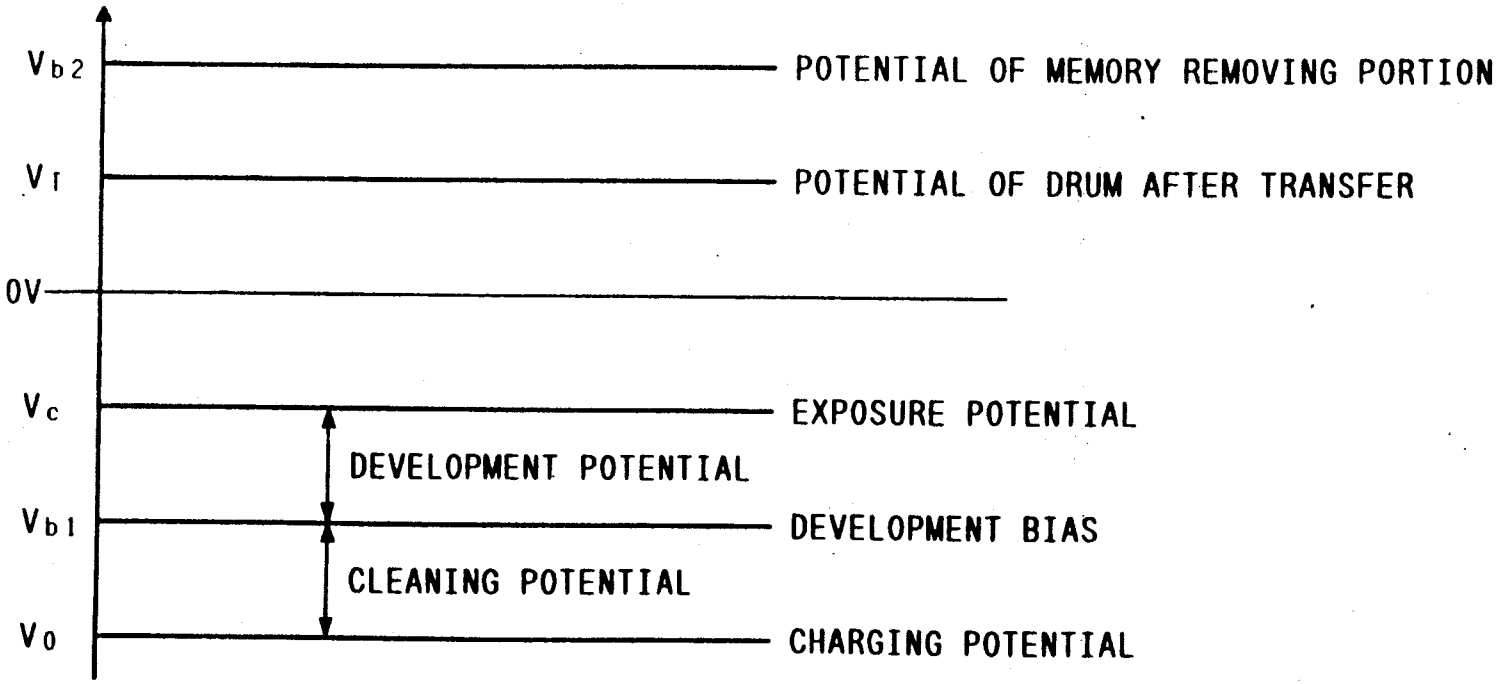
FIG. 17 PRIOR ART
FIG. 17 is an explanatory view of potential distribution.

The charging, exposure, development, transfer and memory removal are similar to those described in connection with FIG. 15. For the high voltage power source to the memory removing member 14, a grid potential of the scorotron type transfer unit 6 is utilized. That is, the varister 9 is connected to a grid 6b, and constant voltage, for example, 560 V is generated by a part of corona current. Accordingly, the grid potential is 560 V, similar to FIG. 15. This voltage is divided by the variable resistor 6e through the resistor 6c and applied to the memory removing member 14 through the resistor 6f.

When the grid potential of the scorotron type transfer unit 6 is utilized for the power source to the memory removing member 14, the voltage applied to the corona wire 6a of the transfer unit 6 is turned on only when the recording paper 8 passes through under the transfer unit 6 and the exposed portion of the photosensitive body before and after the recording paper 8 is not charged to positive. Then, when the rear end of the recording paper 8 passes through the transfer unit 6, the applied voltage to the memory removing member 14 is 0 V. Then, when the photosensitive portion between the memory removing member 14 and the transfer unit 6 in the photosensitive drum 1 when the voltage of the transfer unit 6 is turned off reaches the position of the memory removing member 14, the potential of the memory removing member 14 is 0 V. Therefore, the scattering function of the residual toner cannot be effected. Moreover, since the photosensitive portion between the memory removing member 14 and the transfer unit 6 is charged to a potential after transfer, the toner deposited on the memory removing member 14 moves to the photosensitive body and becomes developed. In the case where the voltage of the transfer unit 6 is turned off after the recording paper has passed, the potential after transfer rises, and therefore, the development of the residual toner to the photosensitive drum is unavoidable.

The capacitor 6d is provided to avoid development to the photosensitive drum 1. The discharge time constant of the capacitor 6d is set so that the voltage of the memory removing member 14 can be stored by the capacitor 6d till the portion of the photosensitive drum positioned when the voltage of the transfer unit 6 reaches the memory removing member 14 to thereby solve the aforementioned problem of the residual toner and prevent the development from the memory removing member 14 to the photosensitive drum 1.

Since the variable resistor 6e is provided to adjust the discharge of the capacitor 6d when not in use and the voltage applied to the memory removing member 14, the variable resistor 6e can be replaced by a fixed resistor or is not always needed. The resistor 6f is a protective resistor which is inserted to prevent an electric shock from the residual voltage of the capacitor 6d during inspection or the like. The resistor 6f may be omitted.

Figure 10:
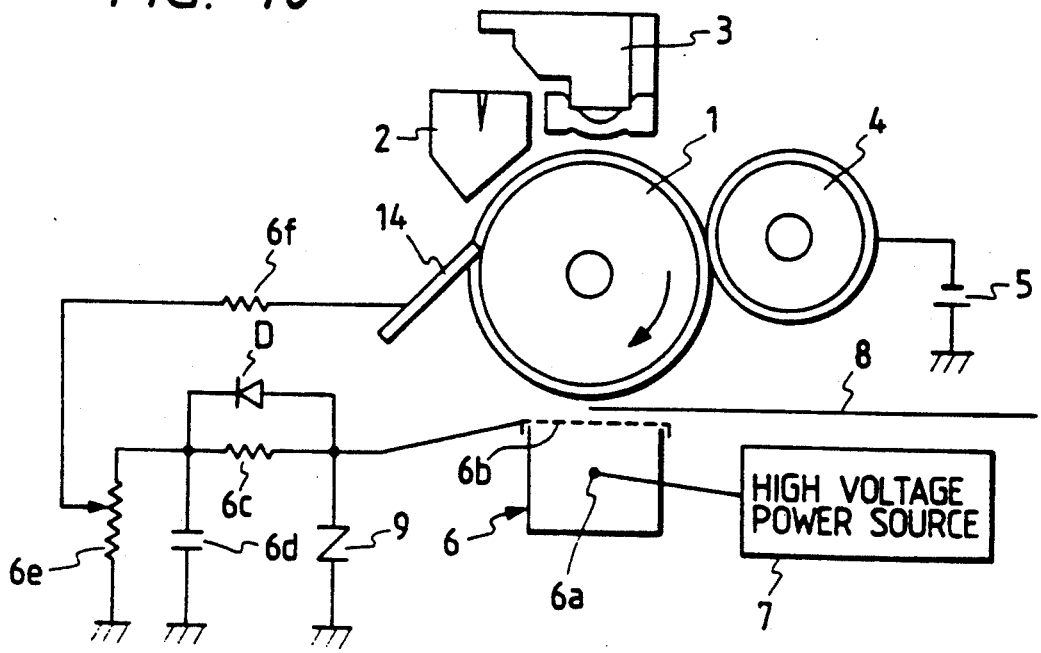
FIG. 10 is a schematic structural view showing parts around an image carrier according to another embodiment of the same.

FIG. 10 is a schematic structural view showing parts around the image carrier according to another embodiment of the above-described image forming apparatus. Parts similar to those of FIG. 9 are indicated by the same reference numerals, and the description thereof will be omitted. In this embodiment, a diode D is connected parallel with the resistor 6c shown in FIG. 9.

When the high voltage power source 7 of the transfer unit 6 is turned on, in the case where the recording paper 8 is not present, the photosensitive body in a portion subjected to an electric field of the transfer unit 6 of the photosensitive drum 1 is charged to a high potential. When the potential of the memory removing member 14 is lower than the potential in the charged portion of the photosensitive drum 1 till the first-mentioned portion reaches the position of the memory removing member 14, the toner deposited on the memory removing member 14 is developed and deposited on the side of the photosensitive drum, adversely influencing on the printing.

When the charge time constant to the capacitor 6d by the resistor 6c is large, even if the voltage of the transfer unit 6 rises, the rise of the applied voltage of the memory removing member 14 is delayed.

FIG. 10 shows an embodiment in which the rise of applied power source to the memory removing member 14 is made faster to prevent development from the memory removing member 14 toward the photosensitive drum. By the connection of the diode D parallel with the resistor 6c, the charge time constant to the capacitor 6d becomes small by the forward resistance of the diode D to enable rising of the terminal voltage of the capacitor 6d substantially simultaneously with the grid potential of the transfer unit 6. Accordingly, when the portion in which the photosensitive drum is charged reaches the position of the memory removing member 14 when the voltage of the transfer unit 6 is applied, a predetermined voltage had already been applied to the memory removing member 14. The toner deposited on the memory removing member 14 is not developed on the side of the photosensitive drum.

It is not limited that the diode D is connected parallel with the resistor 6c but a diode D may be used in place of the resistor 6c. Further, instead of the diode, other directive elements can be used. It is of course that an active element may be used.

The aforementioned voltage value is a mere illustration, and suitable voltage value may be set according to characteristics of toner. Further, the barrister is not limited to one as described above, but other elements such as a Zener diode can be used.

As will be apparent from the above description, according to this embodiment of the present invention, the grid potential of the scorotron type transfer means is utilized as the power source of the memory removing member whereby the applied voltage of the memory removing member can be made in connection with the potential after transfer of the photosensitive body. It is possible to prevent the development to the photosensitive body irrespective of fluctuation of the transfer potential.

There is an effect that by imparting the memory action to the applied power source to the memory removing member, it is possible to completely avoid the development of the memory removing member.

In the aforementioned case, when the application of power source to the transfer unit 6 is effected in synchronism with the printing as in prior art, the charging time of the capacitor at rise poses a problem. This behavior will be described with reference to FIG. 11. The printing sequence can be divided into three stages, i.e., previous rotating stage, printing stage and later rotating stage. The rotation of the motor rises in response to a print start signal, and the power source of the charger is closed and the discharging lamp is also turned on. The developing bias is applied shortly thereafter. The high voltage power source 7 of the transfer unit 6 is turned on as the recording paper is carried.

Figure 11:
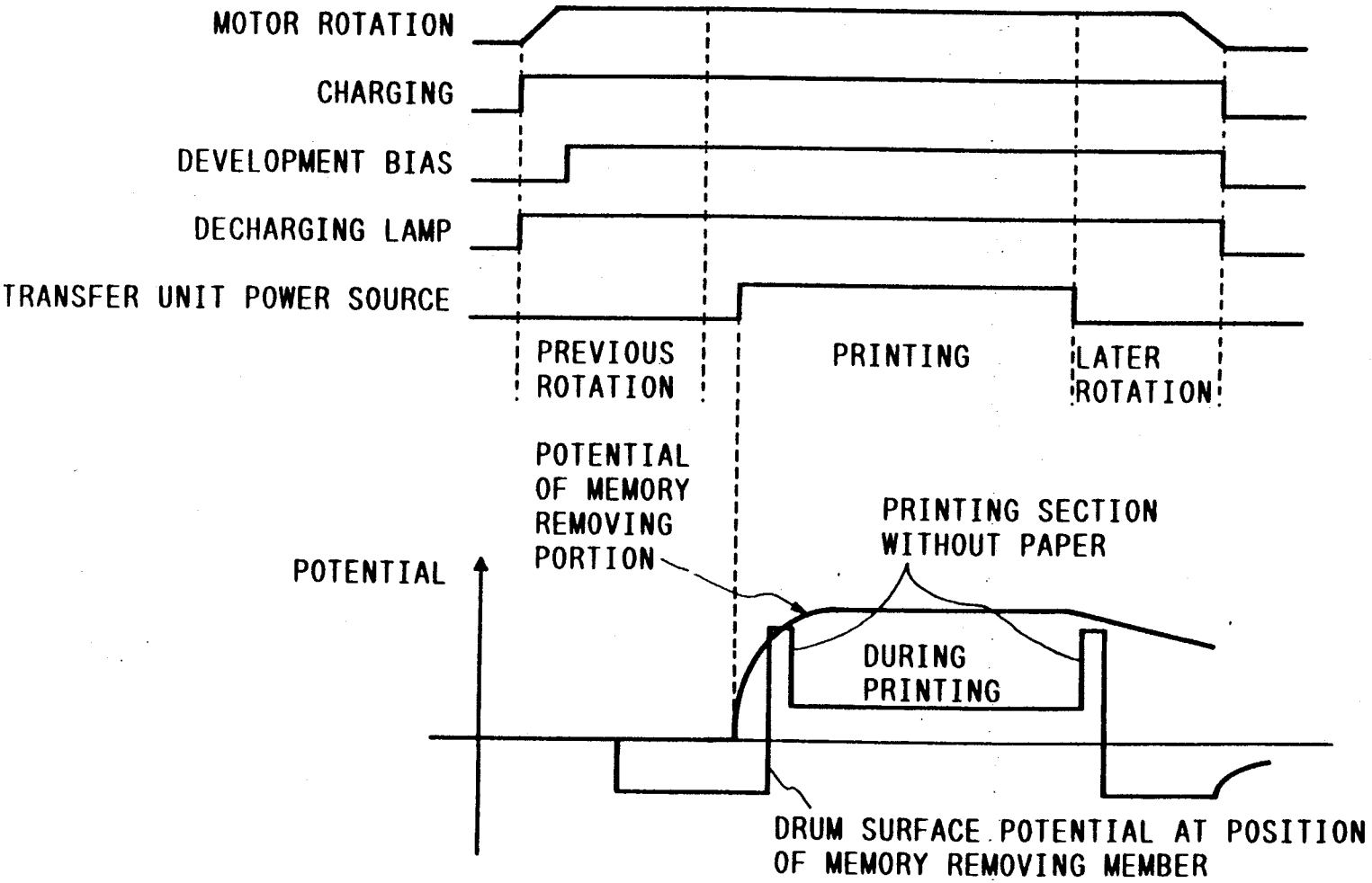
FIG. 11 is an explanatory view of one example of the operation in FIG. 9.

As will be apparent from the above description, when the high voltage power source 7 of the transfer unit 6 is turned on, in the case where the recording paper 8 is not present, the photosensitive body in a portion subjected to an electric field of the transfer unit 6 of the photosensitive drum 1 is charged to a high potential. The potential of the memory removing member 14 is not risen to a sufficient potential due to the time constant of the resistor 6c and the capacitor 6d till said portion reaches the position of the memory removing member 14. Then, as shown in FIG. 11, the potential of a portion in which recording paper is not present, that is, a transfer portion without paper and the charged portion of the photosensitive drum 1 becomes higher than the potential of the memory removing member 14. Accordingly, the toner deposited on the memory removing member 14 is developed and deposited on the side of the photosensitive drum, adversely influencing on the printing.

Figure 12:
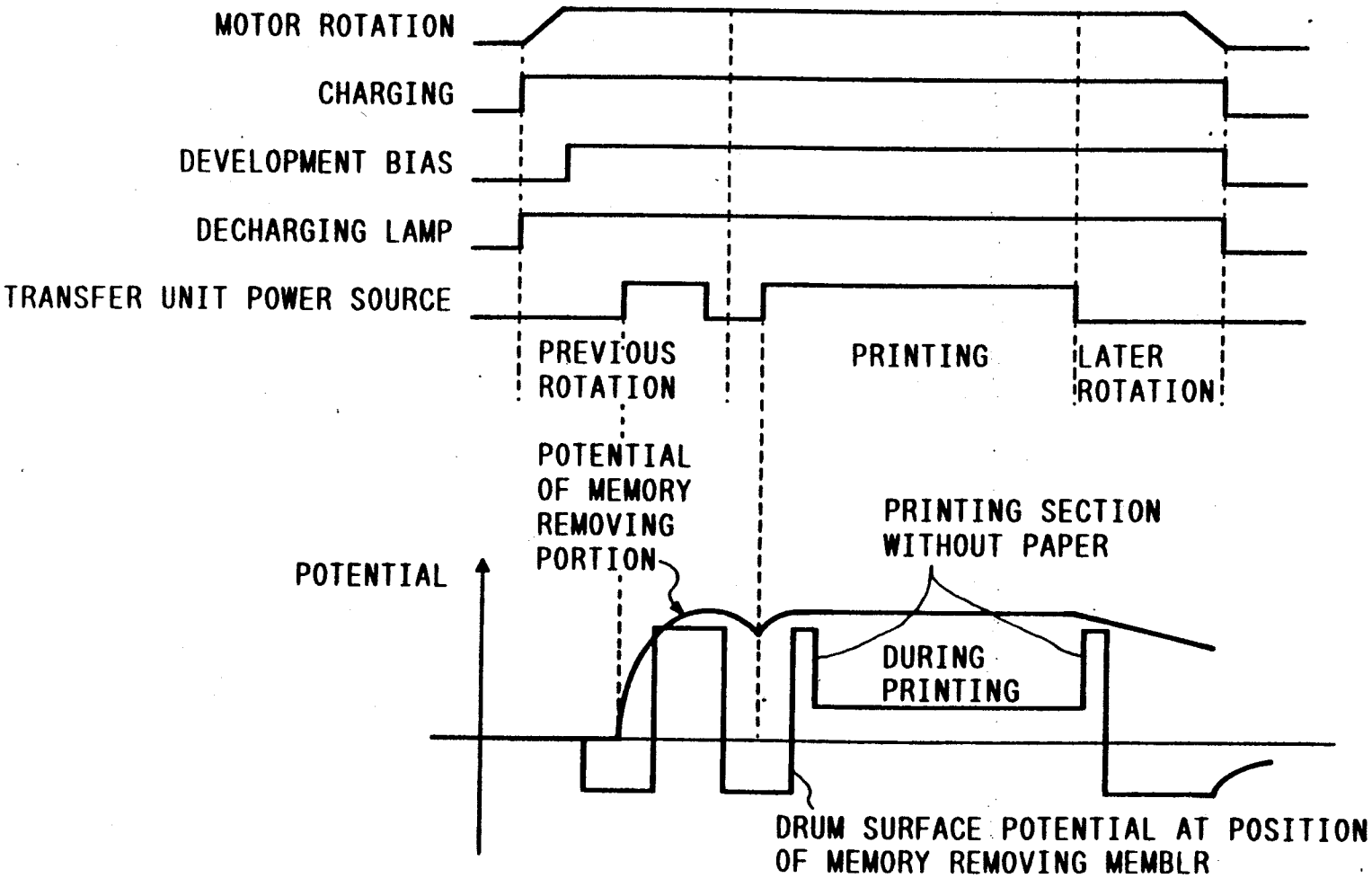
FIG. 12 is an explanatory view of the operation in the embodiment shown in FIG. 9.

FIG. 12 is an explanatory view of the operation of the image forming apparatus which overcomes the influence of the charging time constant of the capacitor 6d. The closure of power source of the high voltage power source 7 described in connection with FIG. 9 is effected during the previous rotation. The closure time of the high voltage power source 7 during the previous rotation is at least time during which the capacitor 6d can be charged. Of course, the power source can be continuously closed till shifting to the printing state. As is understood from FIG. 12, even if the photosensitive drum 1 is transferred without paper, when that portion is rotated and moved to the position of the memory removing member 14, the potential of the memory removing member 14 had already been higher than the surface potential of the photosensitive drum 1. Therefore, the toner deposited on the memory removing member 14 is not developed.

The toner from the memory removing member 14 is developed on the side of the photosensitive drum 1 due to the delay of the charging time when the high voltage power source 7 is turned on, during the previous rotation. However, the aforesaid portion is during the previous rotation and outside the printing area, thus not adversely influencing on the printing.

Since the variable resistor 6e in FIG. 9 is provided to adjust the discharge of the capacitor 6d when not in use and the applied voltage to the memory removing member 14, it can be replaced by a fixed resistor and is not always required. Further, the resistor 6f is a protective resistor which is inserted to prevent an electric shock from the residual voltage of the capacitor 6d during inspection or the like and may be omitted.

Figure 13:
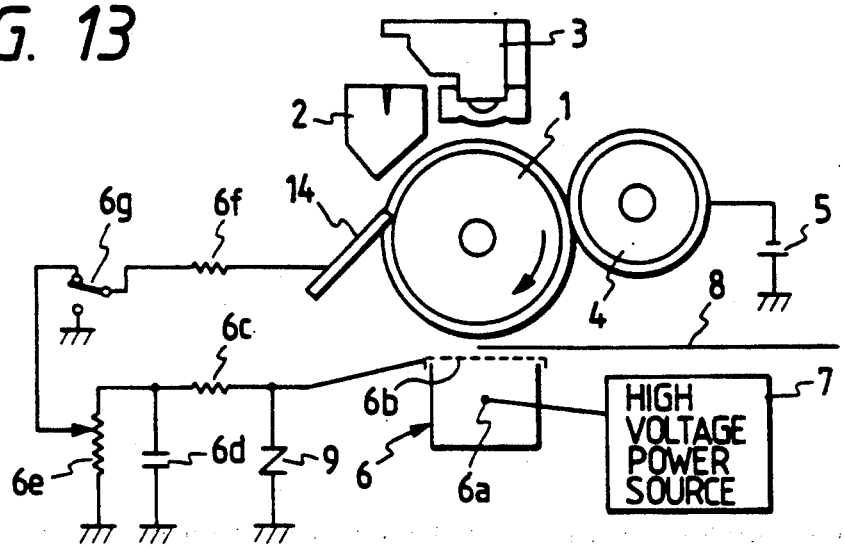
FIG. 13 is a schematic structural view showing parts around an image carrier according to another embodiment.
Figure 14:
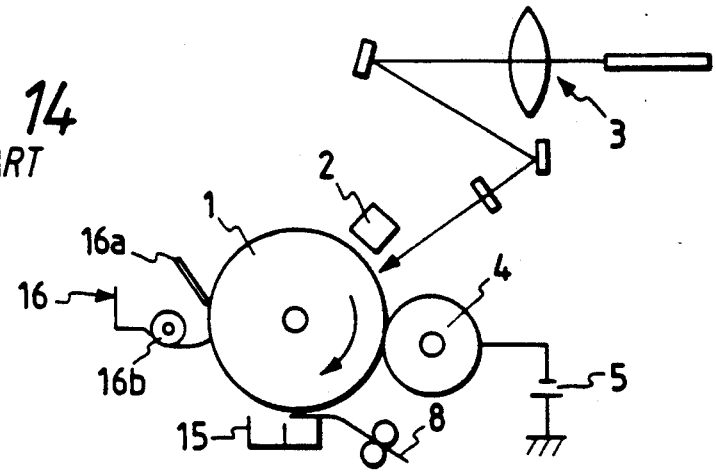
FIG. 14 PRIOR ART
FIG. 14 is a schematic structural view showing parts around an image carrier of a conventional image forming apparatus.

FIG. 13 is a schematic structural view of parts around the image carrier according to still another embodiment of the image forming apparatus of the present invention. Parts similar to those shown in FIG. 9 are indicated by the same reference numerals, and description thereof is omitted. In this embodiment, a switch 6g is provided on a voltage application circuit to the memory removing member 14. When the switch 6g is switched to the side opposite to that shown and the memory removing member 14 is set to a ground potential (which is lower than the charging potential of the photosensitive drum 1), the toner deposited on the memory removing member 14 is developed on the side of the photosensitive drum as will be understood from the foregoing description.

When the apparatus starts, the switch 6g is switched so that the toner deposited on the memory removing member 14 is once transferred to the photosensitive drum, and charged by the charger 2, after which it is cleaned by the developer 4 and recovered into the developer. When the jam occurs, the deposition amount of the toner to the memory removing member 14 becomes excessive. Accordingly, in the previous rotation at the time of start, the switch 6g is switched and rotated once. The toner on the memory removing member 14 and the toner deposited on the photosensitive drum 1 are cleaned, and by shifting to the previous rotation described in connection with FIG. 12, the photosensitive drum and the memory removing member 14 can be cleaned.

The aforementioned voltage value is a mere illustration, and suitable voltage value can be set according to the characteristics of toner or the like. Further, the barrister is not limited to one as described but other elements such as a Zenor diode can be used.

As will be apparent from the foregoing explanation, according to the embodiment of the present invention, the grid potential of the scorotron type transfer means is utilized as the power source of the memory removing member whereby the applied voltage of the memory removing member can be made in connection with the potential after transfer of the photosensitive body. It is possible to prevent development to the photosensitive body irrespective of fluctuation of the transfer potential.

By imparting the memory action to the applied power source to the memory removing member, it is possible to completely avoid the phenomenon of the memory removing member.

What is claimed is:

1. A cleanerless image forming method for scattering toner remained on an image carrier after transfer by a memory removing member to recover the same at a developing section, comprising the steps of:

discrimination step of discriminating a moment at which a power switch is turned on, and execution step of applying a predetermined voltage to a transfer unit when the power switch is turned on, setting a potential of the memory removing member to a zero potential, and re-developing the toner remained on the memory removing member to said iamge carrier.

2. An image forming apparatus, comprising:

charge means for charging an image carrier, exposure means for forming an electrostatic latent image on the image carrier, development means for developing the electrostatic latent image with colored powder, scorotron type transfer means for transferring developed colored powder to a recording medium, and memory removing means, in contact with the image carrier, for disturbing residual colored powder, wherein a grid potential of the scorotron type transfer means is used as an applied power source to the memory removing means and wherein the applied power source comprises memory means.

3. An image forming apparatus according to claim 2, wherein the memory means comprises a capacitor, and wherein the applied power source further comprises a directive element.

4. A toner scattering method for use with a cleanerless image forming apparatus, the apparatus including an image carrier defining a surface, a transfer unit, a developer and a memory removing member defining a potential, the method comprising the steps of:

monitoring the apparatus for jams; and in response to a jam, applying a predetermined voltage to the transfer unit in order to charge the surface of the image carrier to a constant potential, setting the potential of the memory removing member to a potential lower than the charged potential of the surface of the image carrier, whereby toner is transferred from the memory removing member to the image carrier, and connecting a negative power source to the developer, whereby toner is transferred from the image carrier to the developer.

5. A toner scattering method for use with a cleanerless image forming apparatus, the apparatus including an image carrier defining a surface, a transfer unit, a developer and a memory removing member defining a potential, the method comprising the steps of:

applying a predetermined voltage to the transfer unit in order to charge the surface of the image carrier to a constant potential, setting the potential of the memory removing member to a potential lower than the charged potential of the surface of the image carrier, whereby toner is transferred from the memory removing member to the image carrier, and connecting a negative power source to the developer, whereby toner is transferred from the image carrier to the developer.

6. A method for use with a cleanerless image forming apparatus including a power switch, a transfer unit, a memory removing member and an image carrier, the method comprising the steps of:

applying a predetermined voltage to the transfer unit in response to the power switch being turned on, setting the potential of the memory removing member to approximately zero, re-developing toner from the memory removing member to the image carrier.

7. A cleanerless image forming apparatus, comprising:

memory removing means for scattering toner onto an image carrier to remove memory, developer means for recovering the scattered toner and for forming an image, and paper powder capture and recovery means, provided at a point upstream from the memory removing means, for capturing paper powder deposited on the image carrier.

8. A method for forming an image on a recording medium for use with an apparatus comprising an image carrier, a memory removing member and a transfer device defining a grid potential, the method comprising:

charging the image carrier, forming an electrostatic latent image on the image carrier, developing the electrostatic latent image with colored powder, transferring developed colored powder to the recording medium, and applying, prior to transferring the developed colored powder to the recording medium, the grid potential of the transfer device to the image carrier, thereby transferring residual colored powder from the memory removing member to the image carrier.

9. The method of claim 8, wherein the transfer device comprises a scorotron type transfer device.

* * * * *